United States Patent [19]

Rozzen

[11] Patent Number: 4,508,239

[45] Date of Patent: Apr. 2, 1985

[54] TOOTHPASTE DISPENSER

[76] Inventor: David L. Rozzen, 750 Lincoln Rd., No. 67, Yuba City, Calif. 95991

[21] Appl. No.: 471,052

[22] Filed: Mar. 1, 1983

[51] Int. Cl.[3] ..... B67D 5/32; B65D 35/28

[52] U.S. Cl. ..... 222/39; 222/93; 222/96; 222/399; 222/105

[58] Field of Search ..... 222/95, 96, 386.5, 387, 222/105, 192, 325, 389, 399, 481.5, 481, 39, 505, 506, 129, 130, 131, 106

[56] References Cited

U.S. PATENT DOCUMENTS

| | | | |
|---|---|---|---|
| 878,389 | 2/1908 | Henry | 222/386.5 |
| 2,028,302 | 1/1936 | Thomson | 222/39 |
| 2,109,549 | 3/1938 | Piquerez | 222/95 |
| 2,570,755 | 10/1951 | Booth | 222/96 |
| 2,667,287 | 1/1954 | Cook | 222/96 |
| 2,755,967 | 7/1956 | Anderson et al. | 222/389 |
| 2,784,878 | 3/1957 | Theodorou | 222/95 |
| 3,753,516 | 8/1973 | Crider | 222/95 |

*Primary Examiner*—Joseph J. Rolla

*Assistant Examiner*—Andrew Jones

*Attorney, Agent, or Firm*—C. Michael Zimmerman

[57] ABSTRACT

A tube of toothpaste is provided with an internal balloon or similar elastically expansable chamber near its far end, from which a slender inflation tube extends axially out of the neck and is communicated to the exterior of a cap. The cap includes a lateral projection provided with a push to close/pull to open captive closure-type valve. A valved source of compressed gas is communicated to the inflation tube. An actuator is linked both to the cap valve and to the compressed gas valve, so that as the cap valve is opened to dispense toothpaste, the compressed gas valve may be opened to pressurize and inflate the balloon within the tube. Thus the toothpaste reservoir is pressurized for dispensing. The compressed gas line to the inflation tube is provided with a safety valve incorporating a whistle. An appliance is provided housing and mounting the foregoing elements. It may also house and mount toothbrushes and include a floss dispenser.

24 Claims, 10 Drawing Figures

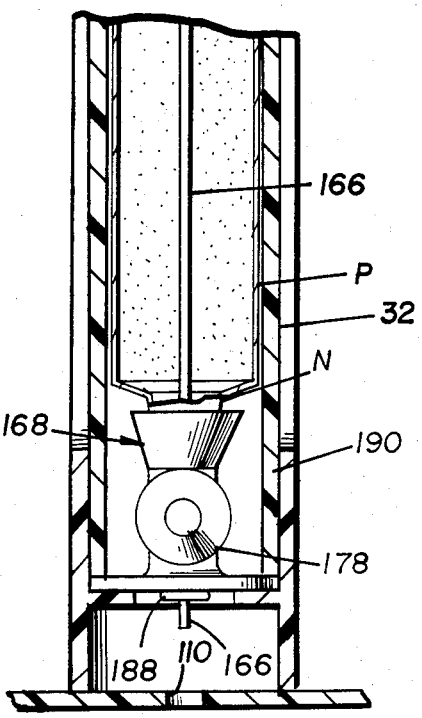
Fig. 3
Fig. 4
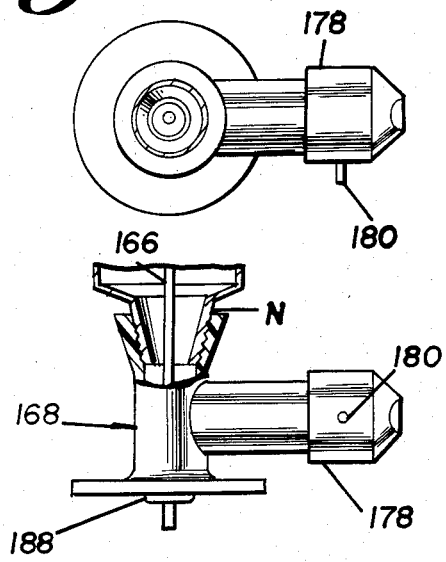
Fig. 5
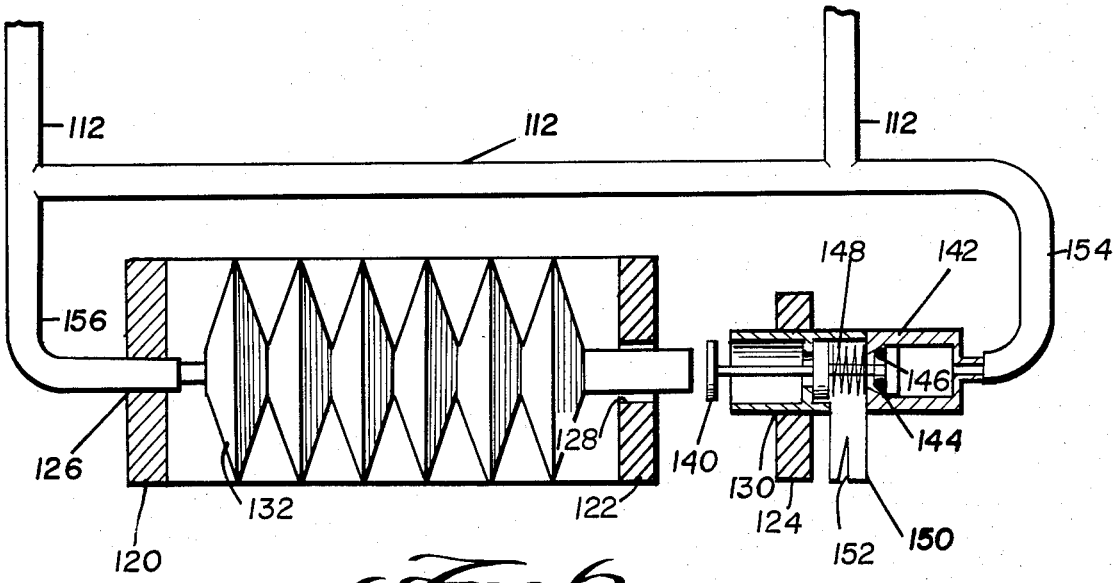
Fig. 6

TOOTHPASTE DISPENSER

BACKGROUND OF THE INVENTION

Various devices in the nature of simple tools and somewhat more complex fixtures and appliances have been conceived for assisting the user in dispensing a quantum of toothpaste on demand from the usual container in which the toothpaste is sold. Some toothpaste is sold in relatively thin-walled collapsible flexible tubes having a crimped-closed, thermally welded-closed, adhered-closed or similarly rather permanently closed far end opposite a shouldered end provided with a tubular neck adapted to receive some type of closure cap, most often a simple screw cap. The present invention relates to ways and means for dispensing toothpaste from such a type of toothpaste tube.

Containers of compressed gas and/or vaporize-upon-depressurization liquid are well known. Some are designed to be recharged through an inlet valve and emptied in spurts over a substantial period of time. Others are sold in a charged condition and meant to be discarded and replaced when the internal pressure falls to so little in excess of one atmosphere that no effective, useful work can be done by further controlled releasing of the gas. The present invention could make use of either type, but the disposable type of compressed gas supply presently is preferred. For instance, photography supply stores carry valved cans of pressurized air used by photographers for blast-cleaning dust and lint from photographic lenses and equipment. Cans of pressurized fluorocarbon fluid are used by refrigerator repairers for repressurizing the refrigerant lines of refrigerators, air conditioners and the like. Similar or identical cans are used by boaters and sports fans for powering horns used for signalling and for expressing enthusiasm. Other pressurized gases and liquids are used in a like manner in either otherwise empty cans, or ones containing a fluent product meant to be dispensed with or by means of releasing pressure by opening a valve on the container. A further example is the well-known carbon dioxide fire extinguisher. Devices according to the present invention may incorporate and make use of such widely commercially available sources of pressurized gas.

Some liquid household cleaning solutions such as liquid dishwashing soap or synthetic detergent are conventionally bottled in flexible plastic squeeze bottles having captive caps which if pushed toward the bottle close and remain sealed, but which if pulled up by a controlled amount open the bottle so that some product may be poured or squeezed out. Hair care products, premixed cake decorating frostings and many other products are packaged in a similar manner. In practicing the present invention one may make use of a similar push-to-close/pull-to-open captive closure-type valve.

Various types, lengths and gauges of elongated flexible string-like or tape-like elements are conventionally sold in coiled form, whether non-waxed, waxed, and whether flavored or non-flavored, for use as floss for mechanically dislodging food particles and accumulated debris from between teeth. Conventionally, the user withdraws a selected length of filament from the spool, cuts it free from the spool, cleans between his or her teeth and then discards the used piece. Often the package in which the spool is vended incorporates an appropriately protected sharp edge against which the filament being withdrawn may be drawn to sever the piece of selected length from the spool. The device of the present invention may include a built-in dispenser for such a spool of dental floss.

SUMMARY OF THE INVENTION

A tube of toothpaste is provided with an internal balloon or similar elastically expansable chamber near its far end, from which a slender inflation tube extends axially out of the neck and is communicated to the exterior of a cap. The cap includes a lateral projection provided with a push to close/pull to open captive closure-type valve. A valved source of compressed gas is communicated to the inflation tube. An actuator is linked both to the cap valve and to the compressed gas valve, so that as the cap valve is opened to dispense toothpaste, the compressed gas valve may be opened to pressurize and inflate the balloon within the tube. Thus the toothpaste reservoir is pressurized for dispensing. The compressed gas line to the inflation tube is provided with a safety valve incorporating a whistle. An appliance is provided housing and mounting the foregoing elements. It may also house and mount toothbrushes and include a floss dispenser.

BRIEF DESCRIPTION OF THE DRAWINGS

FIG. 3 is a fragmentary longitudinal sectional view thereof on a side-to-side vertical plane;

FIG. 4 is a top plan view of the preferred cap used on the toothpaste tube;

FIG. 5 is a fragmentary side elevational view showing the cap of FIG. 4 in use on a toothpaste tube;

FIG. 6 is a fragmentary sectional view on a larger scale of the whistle-incorporating safety valve system shown at the bottom of the apparatus in FIG. 2;

DETAILED DESCRIPTION OF THE PREFERRED EMBODIMENT

Figure 1:
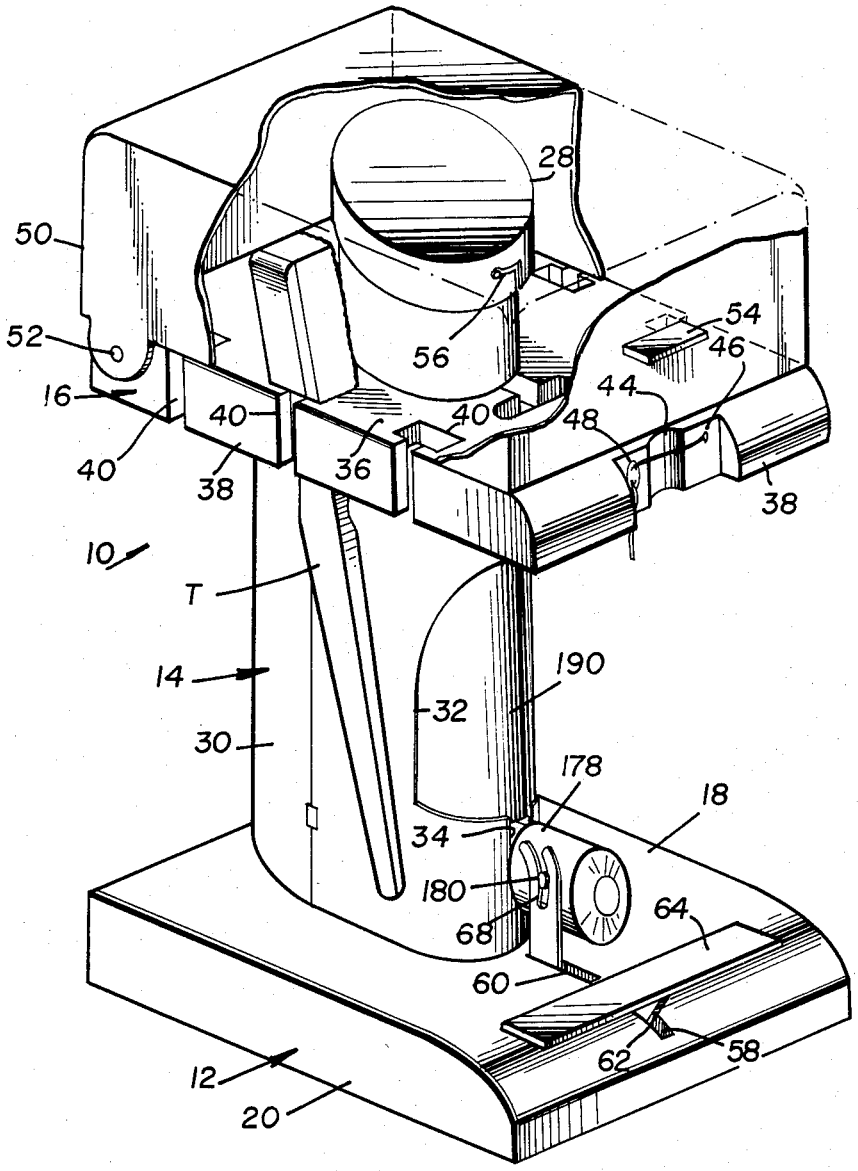
FIG. 1 is a perspective view illustrating a preferred embodiment of an appliance embodying and for practicing the principles of the invention.
Figure 2:
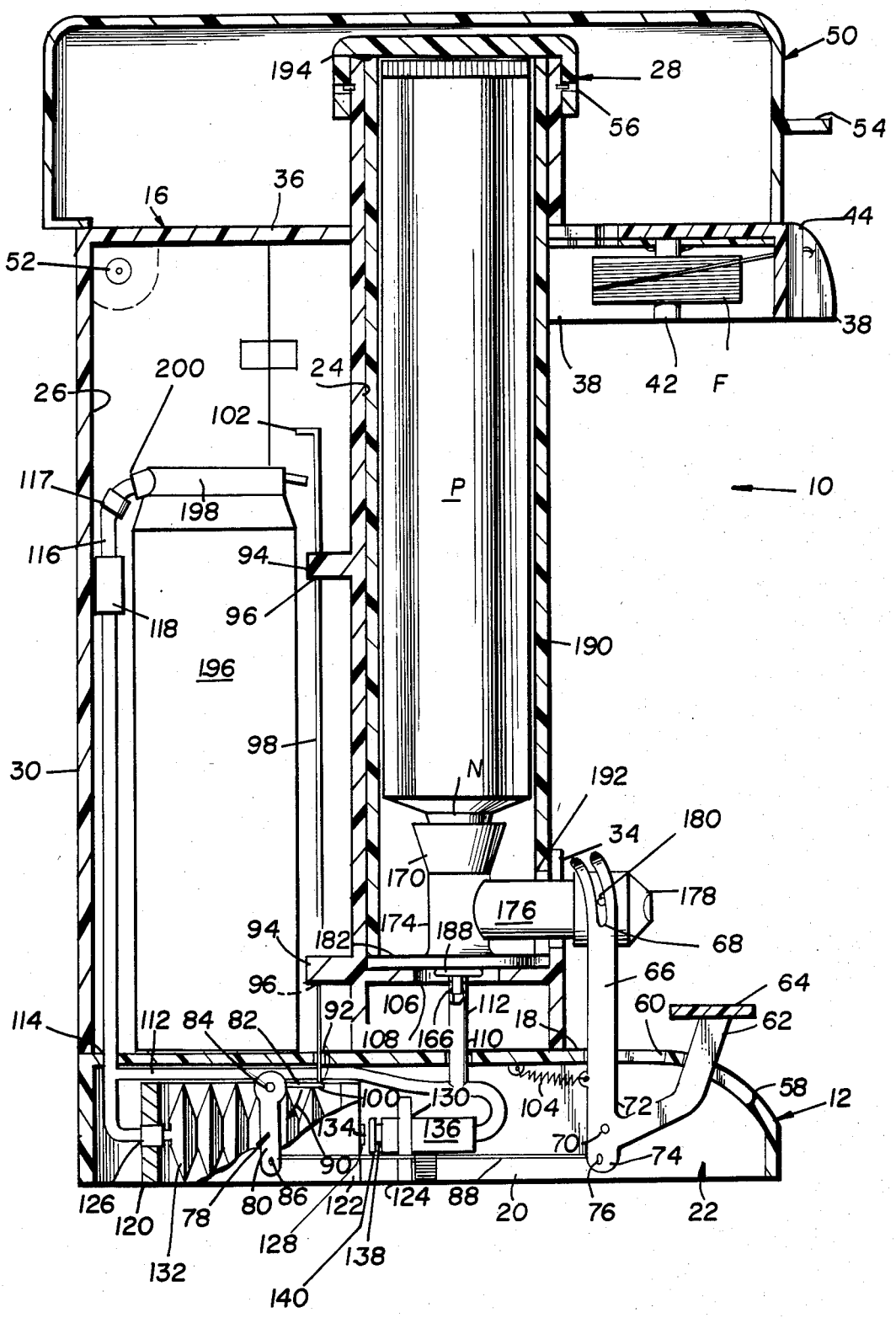
FIG. 2 is a longitudinal sectional view thereof on a front-to-rear vertical plane.

A toothpaste dispenser device is shown at 10 in FIGS. 1 and 2. Portions of the device are illustrated in the other figures. The device 10 of the preferred embodiment is provided so as to be used in the nature of a small appliance, although its toothpaste dispensing function is powered by a self-contained supply of compressed gas, rather than by electricity.

As shown, the device 10 includes a base 12, a body 14, and an elevated deck 16. In the preferred embodiment, the base 12 is relatively broad but not very high, the body 14 is columnar and is centrally based on the base 12 so as to project generally vertically upwardly therefrom, and the deck 16 is cantilevered out from the body 14 at an elevated level. (The conventional toothbrush T gives an idea of the approximate scale.)

The base 12 is shown being a generally flattened-dome shaped structure having a generally horizontal top wall 18 which is perimetrically bounded by a sidewall 20 to define a base compartment 22.

The body 14 which is mounted on the top wall 18 of the base 12 is a generally upright-tubular member having a forward compartment 24 and a rear compartment 26. In the embodiment shown, the rear compartment 26 is topped by the deck 16, but the forward compartment projects up through the deck 16 and is topped by a removable cap 28.

The body 14 has a rear door or hatch cover 30 which may be opened for access to the rear compartment 26. At the front, the body 14 has a large opening 32 into the forward compartment 24, this opening including an upwardly open, relatively narrow anterior notch 34 which reaches down to a short distance above the base 12.

The elevated deck 16 is shown including a generally horizontal main portion 36 with a perimetrical depending skirt 38. The deck 16 may be provided vertically through its thickness near its outer perimeter with slots 40, each for removably vertically downwardly receiving a toothbrush T, handle-end-first, inserted from above until its head comes to rest on the deck 16.

Up under the deck at the front, off toward one side (see FIG. 2) is located a spindle or shaft arrangement 42 on which a spool of floss F may be mounted for rotation. Medially at the front of the deck skirt 38 there is provided a shallow depression 44 laterally oppositely flanked by a floss outlet opening 46 and a floss cutter 48. In use a conventional spool of floss is journalled on the shaft 42 and its leading end is threaded out through the hole 46 and wedged into the floss cutter 48. The latter element may be a replica of those found on conventional consumer packages of dental floss. To obtain a length of floss, the user grasps into the depression 44 to get some floss between his or her fingers, pulls the desired length out through the hole 46 and pulls the trailing end of the desired length into the cutter to sever the desired length from the supply.

The deck 16 is shown openably closed by a dome-like cover 50, e.g., hinged at 52 so as to be swingable upwardly to open about a horizontal transverse axis adjacent the rear of the deck 16. A handle tab 54 is illustrated being provided on the front of the cover to facilitate opening and closing the cover 50 for access to the toothbrushes T and to permit removal of the body cap 28.

Typically the base, body and deck may be made of molded plastic material in as few or as many parts as proves most economical or feasible in the circumstances, with unitary parts either being integrally formed or being made in two or more parts which are then joined together in any convenient manner, e.g. solvent welding or by mechanical fasteners. The cover 30 may be made of transparent plastic material e.g. if visibility of the toothbrush heads is desired.

The body cap 28 is removably mounted on the upper end of the forward compartment of the body 14 by cooperating connector means that permits an initial engagement of the cap and compartment end, followed by a final locking engagement. What is illustrated to provide these, is a bayonet type joint 56 which may be constituted by J-slots on the compartment wall and corresponding logs on the body cap, or vice versa.

The base 12 at the center front is shown provided, aligned one behind the other in front of the body 14, with two longitudinally elongated, laterally narrow slots 58, 60. Up through the foremost slot 58 is shown projecting a mechanism link portion 62 to the upper end of which is shown secured a horizontally, laterally-elongated push bar 64. Normally the link portion 62 is located to the rear of the slot 58, but when the push bar 64 is depressed the link portion 62 moves correspondingly forwardly and downwards in the slot 58.

Up through the slot 60 projects a bifurcated link portion 66 where the elements of the bifurcation project upwardly one behind the other to define between them a laterally accessible, upwardly opening slot 68.

From FIG. 2, it can be seen that in the base compartment 22, the push bar link portion 62 curves posteriorly and intersects the bifurcated link portion 66 at the level where a horizontal, laterally directed pivot pin 70 is mounted to the base. The link 72 incorporating the portions 62 and 66 further incorporates a portion 74 which extends downwardly a short distance below the pivot 70 where it is provided with a pivot joint opening 76 which also extends horizontally, laterally.

Toward the rear, under the rear compartment 26, an L-shaped link 78 is shown pivotally mounted at its elbow in an inverted condition, so that one link leg 80 projects downwards, and the other link leg 82 projects forwards. The pivotal mounting of the link 78 is provided by a horizontal, laterally extending pivot pin 84, which is mounted to the base 12. The lower end of the link leg 80 includes a pivot joint opening 86 which extends horizontally, laterally of the device 10. A rigid link 88 is provided to extend between pivotal connections of the ends thereof to the link portion 74 and link leg 80 by being pivotally hooked through the openings 76 and 86. Accordingly, as the push bar is depressed so as to rotate the link 72 about the pivot pin 70, the slot 68 is pulled correspondingly forwards in the direction of arrow 88, and the link leg 82 is pulled correspondingly downwards in the direction of arrow 90.

In vertical alignment with the forward end of the link leg 82, a small opening 92 is shown formed through the base wall 18.

Within the rear compartment 26 two brackets 94 are shown mounted anteriorly so as to project horizontally posteriorly along the median, one spaced substantially above the other, the two having respective openings 96 therethrough in vertical alignment. A generally vertically extending actuator bar 98 is shown extending down through both eyes 96 and the opening 92, and being pivotally connected to the forward end of the link leg 82 at 100. The upper end of the bar 98, which is shown extending above the upper bracket 94 is there provided with a rearwardly projecting finger 102. Accordingly, as the push bar 64 is depressed, the finger 102 is pulled vertically downwards by a corresponding amount.

In order to return the push bar 64 to its upper, rear (shown) position after it is released from being depressed, a return spring 104 is secured between the link 72 and the base 12.

Below the level of the notch 34 in the large opening 32 in the front of the front compartment 24, the front compartment 24 is shown provided with an internal shoulder 106, which is shown having the form of an annular flange with a central opening 108. Vertically under the opening 108, a small opening 110 is shown formed through the wall 18 of the base 12. A length of rigid tubing 112 is shown projecting upwardly through the opening 110 to a centered position within the opening 108.

Another small opening 114 is shown provided through the wall 18 within and near the rear of the rear compartment 26.

The tube 112, in the base compartment 22 extends rearwards, then up through the opening 114 into the rear compartment 26, where it extends toward the top of that compartment, ending at 116 at a check valve 117. One or more brackets 118 may be provided internally on the wall of the rear compartment 26 for maintaining the position of the tube 112.

Three laterally extending vertical brackets 120, 122 and 124 are shown provided on the base 12 within the base compartment 18. Each has a respective longitudinally horizontal opening 126, 128, 130 provided therethrough, all of these being coaxially aligned on a longitudinally extending horizontal line.

A longitudinally extensible bellows unit 132 is provided in the base compartment 18. Its base end is fixed in the rear opening 126 and its forward end is provided with a plunger 134 which is slidably received in the middle opening 128. The opening 130 in the forward bracket 128 mounts a normally closed safety valve 136, exemplary details of which show more clearly in FIG. 6. The valve 136 includes a stem 138 which has an actuator 140 provided on its rear end, this end being disposed just forwardly of the plunger 134 of the bellows unit 132. At the opposite end of the stem 140, within the cavity provided by the valve housing 142 is a valve body 144 constructed and positioned to normally seal with the valve seat 146 at the urging of a return spring 148. On the downstream side of the valve seat 146, the valve housing 142 is shown provided with a side outlet 150 in which is mounted a whistle 152.

A first branch conduit 154 from the tube 112 extends from near where the tube 112 projects up into the forward compartment 24, to the upstream side of the valve housing 142. A second branch conduit 156 from the tube 112 extends from near where the tube 112 projects up into the rear compartment 26, to the base end of the bellows unit 132.

Accordingly, although the valve 136 is normally closed, if sufficient pressure builds up in the line which includes the tube 112 and its branches 154, 156, the bellows unit 132 expands, urging its plunger 134 forwards. Upon sufficient travel, the plunger 134 engages the actuator 140 in the stem 138, urging the stem 138 forwards sufficiently to open the valve by moving the valve body 144 off the valve seat 146. At this time excess pressure in the line is relieved as the excess compressed gas flows through the open valve and out the side outlet 150, through the whistle 152, thus blowing the whistle to provide an audible signal that a predetermined maximum desired pressure has been achieved in the line 112, 154, 156. As the excess is relieved, the bellows unit 132 relaxes, withdrawing from a depressing relation with the valve stem 138, so that the return spring 148 can release the safety valve.

The apparatus shown in the drawing figures further includes some elements which mount directly to a tube of toothpaste P. These elements are shown in FIGS. 1–5 and 7A–8 and are described hereinbelow.

Figure 7A:
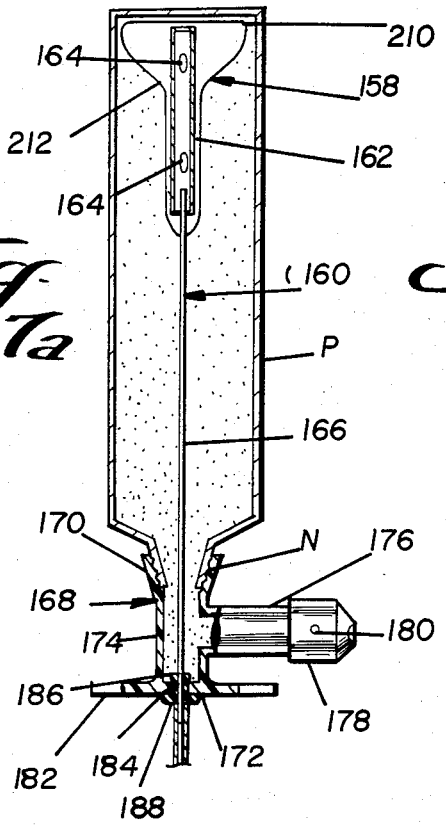
FIGS. 7A, 7B and 7C shows in longitudinal sectional view three states of inflation/pressurization of the balloon as toothpaste is forced from the dispenser.
Figure 7B:
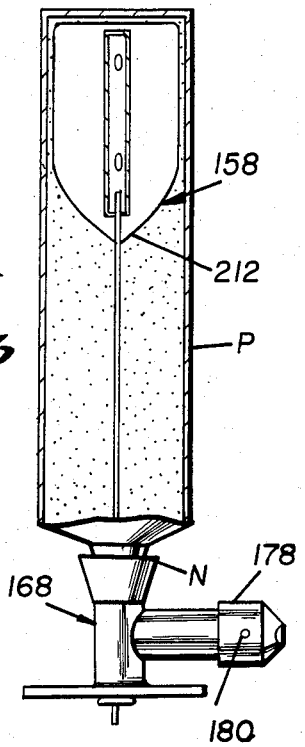
Figure 7C:
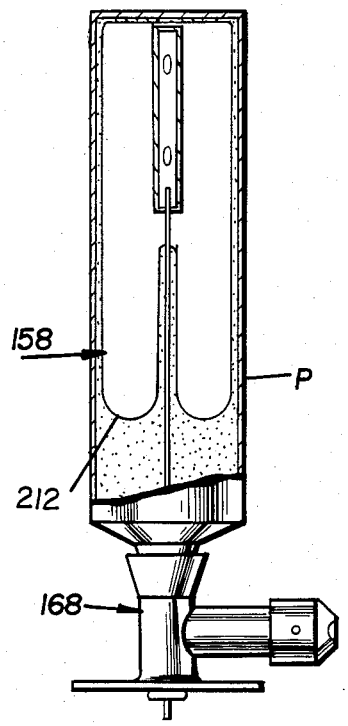

With regard to FIGS. 7A–7C, those of the readers who happen to be familiar with balloon catheters will more easily understand what is depicted. A conventional flexible walled tube of toothpaste is modified by the insertion coaxially through its neck of a balloon 158 sleeved over and sealed to an inflator 160 which includes an internally received inflation head 162 having inflation ports 164 and a relatively slender, stiff inflation tube 166. Of course, the expansible means 158–166 may be installed at the factory by the toothpaste manufacturer. Or, it may be installed in an utterly conventional tube of toothpaste with which it may be boxed or otherwise coordinately packaged for sale, simply by removing the usual cap and inserting the means 158–166 balloon end first, using the tube 166 as an inserter.

The balloon may be made of latex. It should be made of a material which while elastically expansible, is approved for use in contact with toothpaste and which will not permit the pressurization gas to contaminate the toothpaste to any unacceptable degree.

Instead of or in place of the conventional toothpaste cap, a specially designed toothpaste dispenser cap 168 is threaded onto the neck N of the tube of toothpaste P. This cap 168 is elongated between the usual internally threaded skirt 170 and end wall 172 to provide a tubular portion 174 from which forwardly projects a side outlet 176. The forward end of the side outlet 176 is shown provided with a push-to-close/pull-to-open captive closure valve 178, preferably including a laterally extending pin 180. The cap 168 end wall 172 is radially enlarged to provide an annular flange 182. The end wall 172 is further provided with a central opening 184 in which is sealingly fitted a resilient bushing 186 made of gasketing material such as neoprene. The bushing 186 is enlarged by annular bosses inside and outside the cap so as to be secured in place, and the inflation tube 166 is shown terminating within the outer enlargement 188.

The apparatus shown is completed by a sidewall confinement tube 190. This member may be constituted by a tube of rigid plastic material open at its upper and lower ends and notched at 192 contiguous with its lower end.

The toothpaste tube, modified to include the inflator and dispensing cap as described are sleeved in the sidewall confinement tube 190 with the annular flange 182 butted against the lower end of the tube 190 and the side outlet 176 projecting out through the notch 192. The dome-like cover 50 is lifted and the cap 28 is removed. The sub-assembly comprising the toothpaste tube modified to include the inflator and dispensing cap and the tube 190 in which the modified tube is sleeved are lowered into the forward compartment 24 of the body 14. As lowering proceeds, the side outlet 176 with its push-/pull closure valve is hooked out through the opening 32 and the side outlet 176 becomes cradled in the notch 34 and the pin 180 is received in the slot 68 of the bifurcated link portion 66. At this time, the downwardly projecting enlarged boss 188 on the tubular sealing bushing comes to rest in annular engagement with the upper end of the stiff tube 112 and the annular flange 182 on the cap is poised over the shoulder 106. As the cap 28 is reinstalled it pushes down slightly on the upper end 194 of the tube 190 thus seating the flange 182 on the shoulder 106 and limiting to a desired amount the extent by which the boss 188 is compressed into coaxially annular sealing engagement with the upper end of the stiff tube 112.

The compressed gas supply for the device 10 is shown being provided in the form of a disposable can 196 of compressed gas or pressurized liquid which expands as a pressurized gas upon being released to a lower pressure than that prevailing within the can. Dichlorodifloromethane is a preferred pressurized fluid to be the motive fluid contained under pressure in the can 196.

The can 196 conventionally includes a normally closed outlet valve 198 which, if depressed, releases a stream of the pressurized can contants through an outlet spout 200.

The supply of pressurized fluid is installed in the device 10 by opening the hatch or door 30, placing the can 196 inside the rear compartment 26, sealingly fitting the upper end of the conduit 112 into the outlet spout 200, and closing the hatch or door 30.

In typical use of the toothpaste dispenser 10, the user, who has selected his or her toothbrush T holds its bristles in front of the valve 178 and depresses the push bar 64 somewhat. Assuming the system is already pressurized, opening of the valve 178 causes toothpaste to flow out through the valve 178 and onto the toothbrush head. If the flow of toothpaste is slow, indicating low pressure in the system, further depression of the push bar 64 will pull the bar 98 sufficiently downward that the finger 102 depresses the outlet valve actuator on the can 196 of pressurized fluid. Accordingly, some pressurized fluid escapes from the can 196 through the outlet spout 200 into the conduit 112, tending to inflate and pressuring the balloon 158. This tends to make the balloon attempt to occupy more of the internal volume of the toothpaste tube, which tends to pressurize the toothpaste, so that toothpaste will flow out through the open valve 178. Further pressurization of the system is terminated either by voluntary releasing of the push bar 64, or by temporary opening of the safety valve 136 and sounding of the whistle 152, which provides an audible signal that maximum pressurization has been achieved. In practice, one maximum pressurization of the system is sufficient to power several dispensings of respective quantums of toothpaste sufficient for a respective number of toothbrushing experiences. Only when flow is insufficient when the push bar 64 is depressed sufficiently to open the valve 178 need the push bar 64 be depressed further to repressurize the system.

Each time that some toothpaste is dispensed, the balloon 158 will expand in volume due to its internal pressurization, gradually filling more and more of the internal volume of the toothpaste tube. Three snapshots in respective successive stages of emptying of the toothpaste tube of toothpaste are illustrated in FIGS. 7A, 7B and 7C.

Figure 8:
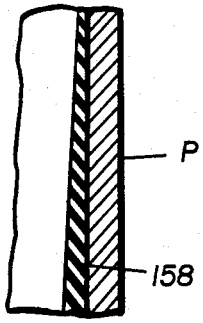
FIG. 8 is a fragmentary longitudinal sectional view taken on line 8—8 of FIG. 7C and showing a preferred gradation in the wall thickness of the balloon.

Preferably the balloon 158 is carefully configured so that it will inflate from its distal end 210 first so that no toothpaste is trapped behind it and so that all of the toothpaste is gradually forced toward and out of the mouth of the toothpaste tube. A feature which particularly helps to ensure the desired progress of inflation is the provision of a gradation in wall thickness of the balloon 158. As is illustrated in FIG. 8, which is an expanded-scale fragmentary longitudinal sectional view on the line 8—8 of FIG. 7C, the balloon 158 is preferably tapered in thickness toward its distal end 210, and gradually increases in thickness toward its mouth. Accordingly, upon introduction of inflating, pressurizing gas into the balloon, and upon evacuation of some toothpaste from the toothpaste tube, the balloon will tend to inflate first where the balloon wall is thinnest and progressively along its length toward the balloon mouth as inflation stretches and thins the balloon wall at the shoulder 212 next to the inflated portion.

The can of pressurized gas should last a long time because so little needs to be used. For instance, a new can may be required only after several tubes of toothpaste have been fully exhausted using the apparatus of the invention.

It should now be apparent that the toothpaste dispenser of the present invention possesses each of the attributes required for carrying out the principles of the invention. Modifications are possible within the scope of the following claims.

What I claim is:

1. Apparatus for dispensing toothpaste from an elongated container of toothpaste which includes a tubular neck at one end, said neck having a mouth, said apparatus comprising:

a stiff pressurization tube which is relatively slender compared to said neck and mouth;

an inflater head mounted on one end of said pressurization tube and having at least one outlet opening through which pressurized fluid injected into said pressurization tube may issue;

a balloon sleeved over said inflater head and having a balloon neck circumferentially sealed relative to the external periphery of said pressurization tube, so that as pressurized fluid issues from said at least one outlet opening of said inflater head, such pressurized fluid will pressurize and tend to inflate said balloon;

a dispenser cap for said container neck including cooperative securement means for securing said dispenser cap on said container neck;

said dispenser cap including an openable/closeable valve which, only when in an open condition, allows toothpaste to flow out through said mouth of said container neck, under motivation provided by superatmospheric pressure within said balloon due to pressurization of said balloon by injection of pressurized fluid thereinto via said pressurization tube and inflater when said balloon is disposed within said container on said inflater head;

said pressurization tube having an inlet end;

said dispenser cap including an opening having an annular gasket sealingly fitted therein; said pressurization tube near said inlet end thereof being circumferentially sealingly received in said annular gasket so that said pressurization tube may be supplied with pressurized fluid through said inlet end from externally of the toothpaste container while said dispenser cap remains in place on said neck;

the dispenser cap including an internally threaded skirt as said cooperative securement means; a tubular coaxial extension of said skirt, and an axially outer end wall; a tubular side outlet communicating laterally through the tubular coaxial extension with the interior of the cap; said openable/closeable valve being provided on said tubular side outlet distally of said tubular coaxial extension;

said opening of said dispenser cap in which said annular gasket is fitted being provided in said axially outer end wall of said dispenser cap;

said annular gasket further including an annular boss located externally of said outer end wall of said dispenser cap for facilitating connection of a source of pressurizing fluid to said inlet end of said pressurization tube from externally of said dispenser cap, said pressurization tube, from externally of said dispenser cap being constructed and arranged for connection with a source of pressurizing fluid.

2. The apparatus of claim 1, wherein:

said pressurization tube is of such a length that when said balloon, inflater head and pressurization tube are received in said container and said dispenser cap is mounted to said tubular neck, said balloon becomes disposed adjacent an opposite end of the container from said one end, prior to substantial inflation of said balloon.

3. The apparatus of claim 2, wherein:

said balloon is provided with a gradually decreasing wall thickness proceeding longitudinally of the balloon away from the balloon neck, so that the balloon upon pressurization tends to first inflate distally of the balloon neck and gradually towards the balloon neck.

4. The apparatus of claim 1, wherein:

said openable/closeable valve is constituted by a push-to-close/pull-to-open captive closure-type valve.

5. The apparatus of claim 1, wherein:

said dispenser cap further includes an annular flange projecting radially beyond said tubular coaxial extension and adapted to serve as a support shoulder for the container of toothpaste when such container is fitted with said apparatus and disposed in an inverted condition.

6. Apparatus for dispensing toothpaste, comprising:

an elongated container of toothpaste, said container including wall means defining a tubular neck at one end, said tubular neck having a mouth, and defining a closed end distally of said tubular neck;

a stiff pressurization tube which is relatively slender compared to said neck and mouth;

an inflater head mounted on one end of said pressurization tube and having at least one outlet opening through which pressurized fluid injected into said pressurization tube may issue;

a balloon sleeved over said inflater head and having a balloon neck circumferentially sealed relative to the external periphery of said pressurization tube, so that as pressurized fluid issues from said at least one outlet opening of said inflater head, such pressurized fluid will pressurize and tend to inflate said balloon;

a dispenser cap for said container neck including cooperative securement means for securing said dispenser cap on said container neck;

said dispenser cap including an openable/closeable valve which, only when in an open condition, allows toothpaste to flow out through said mouth of said container neck, under motivation provided by superatmospheric pressure within said balloon due to pressurization of said balloon by injection of pressurized fluid thereinto via said pressurization tube and inflater;

said pressurization tube having an inlet end;

said dispenser cap including an opening having an annular gasket sealingly fitted therein; said pressurization tube near said inlet end thereof being circumferentially sealingly received in said annular gasket so that said pressurization tube may be supplied with pressurized fluid through said inlet end from externally of the toothpaste container while said dispenser cap remains in place on said neck;

the dispenser cap including an internally threaded skirt as said cooperative securement means; a tubular coaxial extension of said skirt, and an axially outer end wall; a tubular side outlet communicating laterally through the tubular coaxial extension with the interior of the cap; said openable/closeable valve being provided on said tubular side outlet distally of said tubular coaxial extension;

said opening of said dispenser cap in which said annular gasket is fitted being provided in said axially outer end wall of said dispenser cap;

said annular gasket further including an annular boss located externally of said outer end wall of said dispenser cap for facilitating connection of a source of pressurizing fluid to said inlet end of said pressurization tube from externally of said dispenser cap, said pressurization tube being constructed and arranged for connection with a source of pressurizing fluid; and a source of pressurizing fluid connected with said inlet end of said pressurization tube from externally of said dispenser cap.

7. The apparatus of claim 6, wherein:

said balloon, inflater head and pressurization tube being received in said container and said dispenser cap being mounted to said tubular neck; said pressurization tube being circumferentially sealed with respect to said tubular neck by said annular gasket; said balloon being disposed adjacent said closed end of said container prior to substantial inflation of said balloon.

8. The apparatus of claim 7, wherein:

said balloon is provided with a gradually decreasing wall thickness proceeding longitudinally of the balloon away from the balloon neck, so that the balloon upon pressurization tends to first inflate distally of the balloon neck and gradually towards the balloon neck.

9. The apparatus of claim 6, wherein:

said openable/closeable valve is constituted by a push-to-close/pull-to-open captive closure-type valve.

10. The apparatus of claim 6, wherein:

said dispenser cap further includes an annular flange projecting radially beyond said tubular coaxial extension and adapted to serve as a support shoulder for the container of toothpaste when such container is fitted with said apparatus and disposed in an inverted condition.

11. A toothpaste dispenser for dispensing toothpaste from a container of toothpaste, which container is provided with a pressurizable, expansible chamber initially disposed distally of a mouth of such container, a pressurization conduit communicated to said chamber, and an openable/closeable toothpaste outlet valve for said container mouth, so that when said chamber is pressurized through said pressurization conduit, if said openable/closeable toothpaste outlet valve is opened, toothpaste will flow out of said chamber through said container mouth as said container expands towards said container mouth, said toothpaste dispenser comprising:

a device including a body mounted on a base;

said body including means defining a first compartment for mounting said container so that said openable/closeable toothpaste outlet valve is located where a user may conveniently place a bristled head of a toothbrush in proximity thereto;

said body including means defining a second compartment for mounting a self-contained supply container of pressurized fluid having a normally-closed, push-to-open valve having an outlet; and tube means for connecting said outlet of said valve of said self-contained supply of pressurized fluid with said pressurization conduit, so that by pushing said push-to-open valve said expansible chamber within said container of toothpaste may be pressurized, so that when said openable/closable toothpaste outlet valve is opened, toothpaste will flow therefrom onto the bristled head of the toothbrush placed by the user in proximity thereto.

12. The toothpaste dispenser of claim 11, further including:

a safety valve incorporated in said tube means, said safety valve being constructed and arranged to vent to atmosphere excess pressurized fluid should the user continue to push said push-to-open valve of said self-contained supply of pressurized fluid when said pressurizable, expansible chamber has already become pressurized to a predetermined maximum desirable amount.

13. The toothpaste dispenser of claim 12, wherein:

said safety valve includes an outlet to atmosphere which outlet incorporates a whistle for providing an audible signal upon achievement of said predetermined maximum desirable amount of pressurization.

14. The toothpaste dispenser of claim 11, wherein:

said base includes a pivotally mounted mechanism including first link means constructed and arranged for operative connection to said openable/closeable toothpaste outlet valve so that as said first link means is pivoted in one angular sense the openable/closeable toothpaste outlet valve when connected therewith will be opened thereby and when pivoted in an opposite angular sense the openable/-closeable toothpaste outlet valve when connected therewith will be closed thereby; and a second link means mounting an actuator bar externally of said base, said second link means being operatively connected to said first link means within said base, so that as said actuator bar is manually moved by the user in one sense, said first link means is pivoted in said one angular sense.

15. The toothpaste dispenser of claim 14, further comprising:

spring means mounted between said pivotally mounted mechanism and said base for returning said second link means after manual movement of said actuator bar by the user, for automatically closing said openable/closeable toothpaste outlet valve.

16. The toothpaste dispenser of claim 14, wherein:

said first link means and said second link means are integrally provided on a common link.

17. The toothpaste dispenser of claim 14, wherein:

said pivotally mounted mechanism further includes a remotely operable mechanical finger for pushing said push-to-open valve.

18. The toothpaste dispenser of claim 17, wherein:

said pivotally mounted mechanism further includes means operatively connecting said remotely operable mechanical finger to said second link means with a lost motion provision so that the actuator bar may be manually moved in said one sense up to a certain amount to cause said first link means to open said openable/closeable toothpaste outlet valve without causing said mechanical finger to push said push-to-open valve sufficiently to cause pressurized fluid to flow from said self-contained supply into said pressurization conduit, but the actuator bar may be manually moved in said one sense beyond said certain amount to also cause said mechanical finger to push said push-to-open valve sufficiently to cause pressurized fluid to flow from said self-contained supply into said pressurization conduit.

19. The toothpaste dispenser of claim 11, wherein:

said body is generally columnar and said first and second compartments are of generally upright tubular configuration with said first compartment being disposed contiguously forwardly of the second compartment and having an upper end openably closed by a removable cap, so that the container of toothpaste may be inserted in the first compartment in an inverted, mouthdown, orientation through said upper end and said removable cap may be reinstalled; said first compartment having frontally disposed opening means out through which said openable/closeable toothpaste outlet valve may forwardly project.

20. The toothpaste dispenser of claim 19 further comprising a deck cantilevered from said body at a level elevated above said base, said deck having means defining a plurality of generally perimetrically located slots vertically therethrough each for removably receiving the handle of a respective toothbrush, so that said deck may hangingly removably support by their respective heads a plurality of toothbrushes.

21. The toothpaste dispenser of claim 20, further comprising:

a dental floss dispenser built into said deck.

22. The toothpaste dispenser of claim 20, further comprising:

a dome-like cover and means hinging the dome-like cover to the deck for removably covering the heads of such toothbrushes as are hangingly supported in the slots on said deck.

23. The toothpaste dispenser of claim 19, wherein:

said base includes means defining an opening centrally upwardly into said first compartment and said body includes means defining an internal annular flange in said first compartment near said base for supporting container thereon; and said tube means includes a stiff end portion projecting from within said base up through said opening in said base generally to the level of said internal annular flange in said first compartment so that as said container of toothpaste is inserted into said first compartment in an inverted condition, an end of the pressurization conduit of the container of toothpaste may be stabbed into connection with said stiff end portion of said tube means, and forced into maintained, sealing engagement therewith by installation of said removable cap on the upper end of said first compartment.

24. The toothpaste dispenser of claim 23, further including:

a rigid tubular jacket for radially bounding substantially all of the container of toothpaste but for said openable/closeable toothpaste outlet valve when said container of toothpaste is a flexible walled tube, said jacket being removably telescopically received in said first compartment through said upper end.

* * * * *